US005518295A

United States Patent [19]

Westerburgen

[11] Patent Number: 5,518,295

[45] Date of Patent: May 21, 1996

[54] CHAIR WITH AN ADJUSTABLE BACK PART

[75] Inventor: Josephus P. M. Westerburgen, Heythuysen, Netherlands

[73] Assignee: Lawn Comfort S.A., Alleur, Belgium

[21] Appl. No.: 299,352

[22] Filed: Sep. 1, 1994

[30] Foreign Application Priority Data

Sep. 2, 1993 [NL] Netherlands ..... 9301518

[51] Int. Cl.[6] ..... B60N 2/02

[52] U.S. Cl. ..... 297/367; 297/356

[58] Field of Search ..... 297/367, 356, 297/366, 378.12

[56] References Cited

U.S. PATENT DOCUMENTS

| | | | |
|---|---|---|---|
| 457,125 | 8/1891 | Liesenbein | 297/356 X |
| 970,635 | 9/1910 | Matthes | 297/356 X |
| 3,484,831 | 12/1969 | Higuchi | 297/356 X |
| 5,169,257 | 12/1992 | Liou | 297/356 X |
| 5,397,168 | 3/1995 | Hand | 297/367 X |

FOREIGN PATENT DOCUMENTS

| | | | |
|---|---|---|---|
| 353146 | 5/1961 | Switzerland . | |
| 1149761 | 4/1967 | United Kingdom | 297/356 |

OTHER PUBLICATIONS

Netherlands Search Report (1994).

*Primary Examiner*—Laurie K. Cranmer
*Attorney, Agent, or Firm*—Cushman Darby & Cushman

[57] ABSTRACT

Chair comprising a seat part and a back part that are hinged together, the back part being movable relative to the seat part between two extreme positions, one of the parts being provided with a toothed segment having teeth shaped like sawteeth, the other part being provided with a catch which engages with the toothed segment to fix the latter in various positions at least against a movement in one direction, and means that press the catch against the toothed segment, the toothed segment containing a cam that engages with a cam follower connected to the catch, the cam pressing the catch away from the toothed segment in one extreme position of the back part, holding devices being present to retain the catch in this position and release devices that release the catch from the holding devices in the other extreme position of the back part.

In addition, means may be present that can be actuated by hand to release the catch from the toothed segment in any desired position of the back.

6 Claims, 2 Drawing Sheets

CHAIR WITH AN ADJUSTABLE BACK PART

The invention relates to a chair comprising a seat part and a back part which are hinged together, the back part being movable relative to the seat part between two extreme positions, one of the parts being fitted with a toothed segment, having teeth shaped like sawteeth, and the other part being fitted with a catch which engages with the toothed segment in order to fix it in various positions at least against a movement in one direction, and means that press the catch against the toothed segment.

Such a chair is known from the U.S. Pat. No. 3,352,580.

With the known chair use is made of a double catch system in order to move and fix the back part between two extreme positions. To this end one catch is movable between two positions to ensure that the toothed segment and the catches do not mesh together. The tops of the teeth of the toothed segment so to speak slide over the movable catch.

Such a system of course produces substantial frictional force, which, certainly when used in chairs made of plastic, causes increased wear and after a short time an insufficiently reliable operation of the adjusting mechanism.

The aim of the invention is to provide a chair of the aforementioned type with which this drawback is avoided.

This aim is achieved according to the invention because the toothed segment contains a cam which engages with a cam follower connected to the catch, the cam forcing the catch away from the toothed segment in one extreme position of the back part, because holding devices are present to retain the catch in this position, and because release devices are present to release the catch from the holding devices in the other extreme position of the back part.

Because the catches are completely free from the toothed segment the aforementioned wear can no longer occur and a moving mechanism is obtained that can be active more equivocally in several positions.

With a chair according to the invention means are preferably present that can be actuated by hand to release the catch from the toothed segment in any desired position of the back part.

This makes it possible to adjust the back part at random at any moment without having to perform the movement back and forth to the second extreme position and then to the first extreme position.

Figure 1:
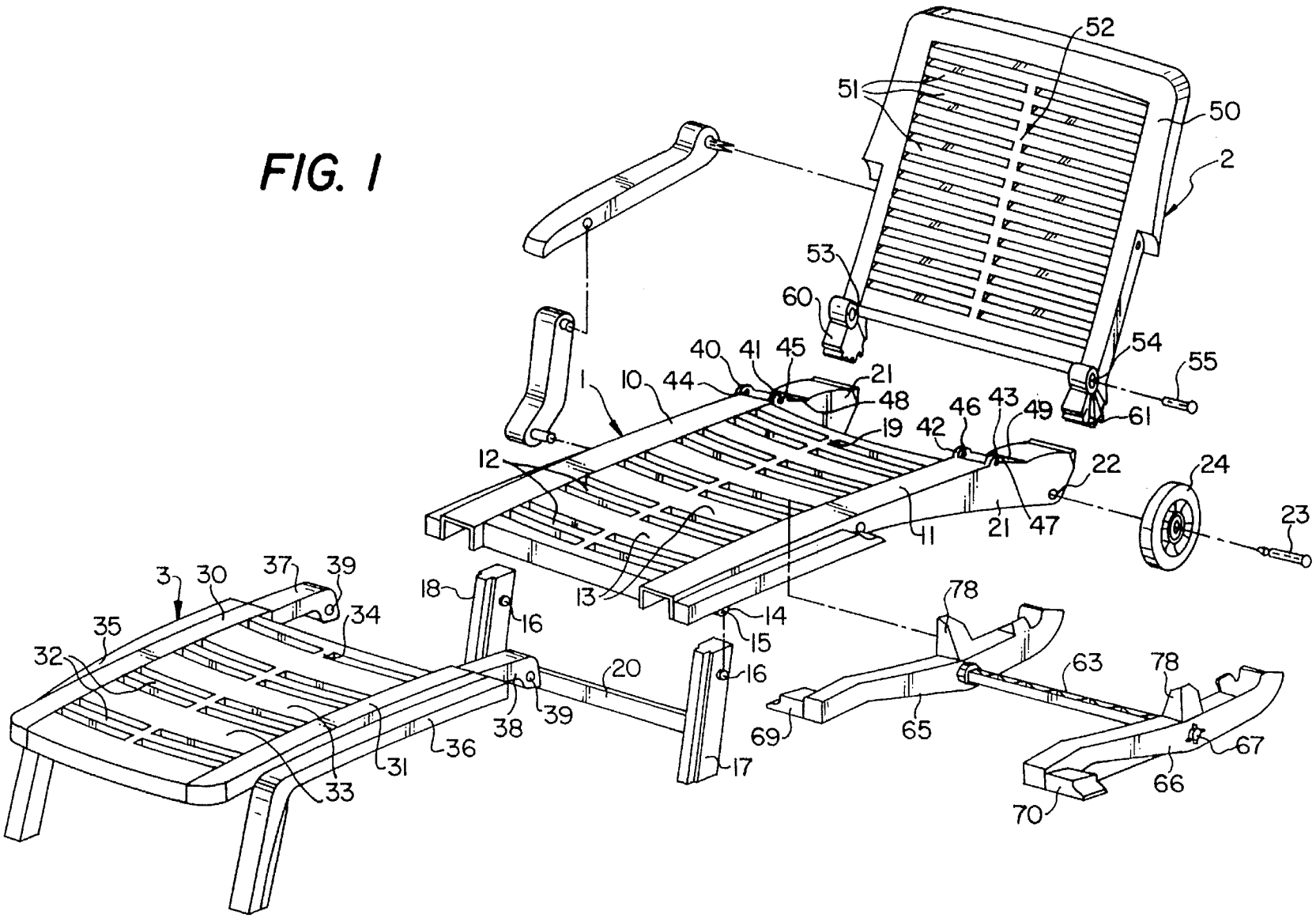
Figure 2:
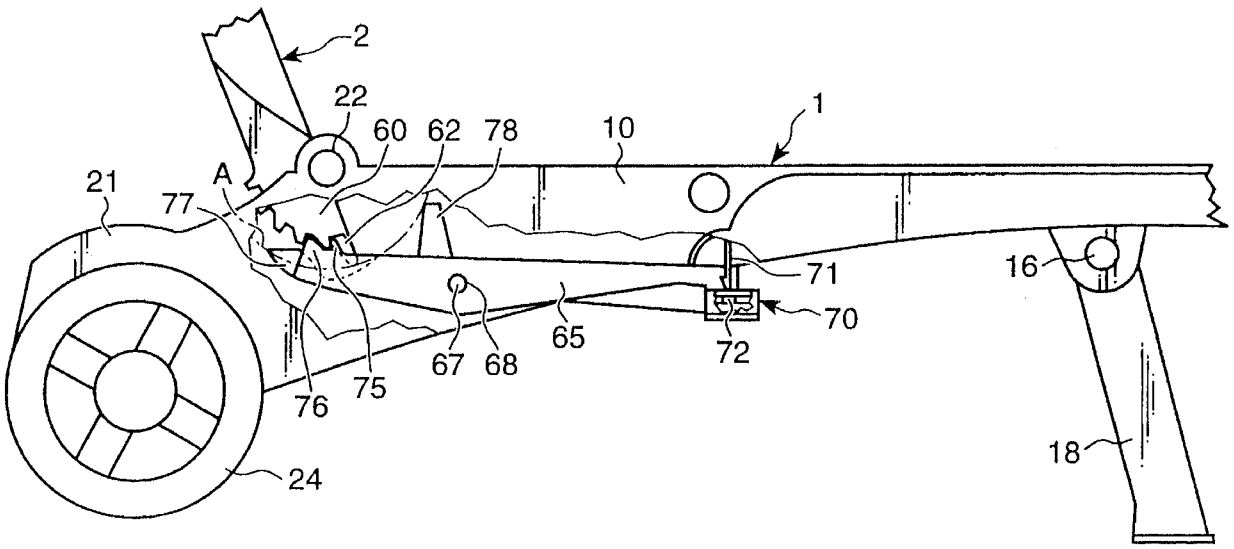
Figure 3:
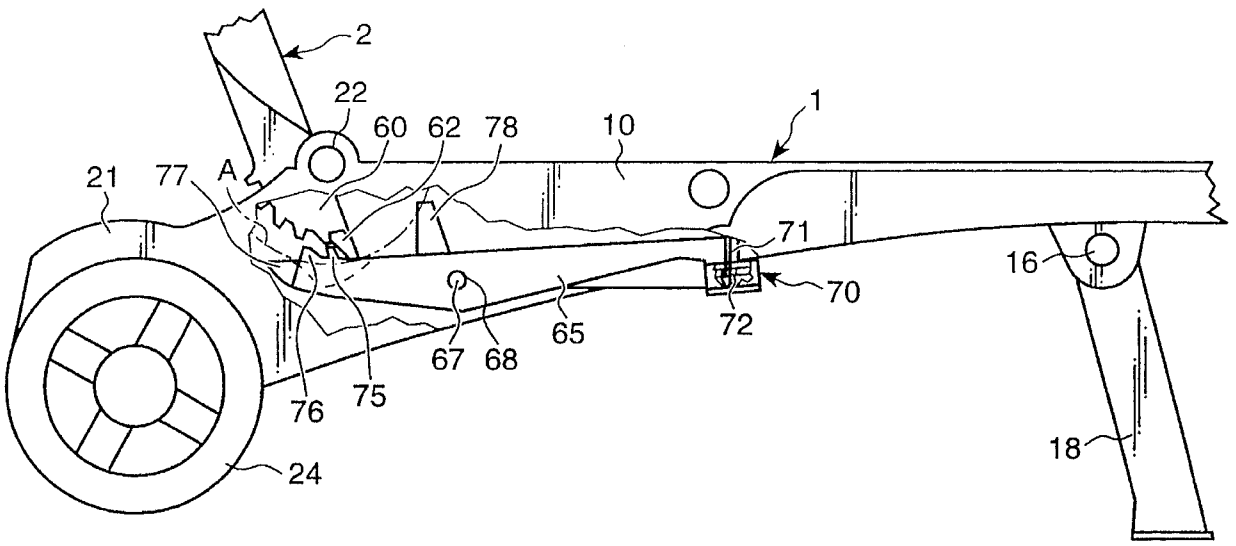

Other characteristics and advantages will become clear from the following description, in which reference is made to the appended drawings, in which:

FIG. 1 is a schematic perspective exploded view of a chair according to the invention, FIG. 2 is a partly cross-sectional side view of part of the chair according to FIG. 1 and FIG. 3 is a side view as in FIG. 2, in which the adjusting mechanism for the back part is in a different position.

The chair as represented in FIG. 1 is composed of a seat part (1), a back part (2) and a footrest (3), but it is clear that the invention is not limited to this type of chair, but that a chair without a footrest also comes within the scope of the invention.

The seat part is composed of two longitudinal profiled parts (10 and 11) having a substantially U-shaped cross section, which are connected to one another by a number of transverse connections consisting alternately of narrow profiled parts (12) with U-shaped cross sections and wide profiled parts (13) with U-shaped cross sections. The openings of the profiled parts (10, 11, 12 and 13) face downwards, the web plates of the profiled parts substantially lying in one plane and hence constituting the supporting surface of the seat part. To increase the sturdiness of the seat part a longitudinal connection (19) is provided halfway between profiled parts 10 and 11, which connects profiled parts 12 and 13 to one another.

Near the end facing the footrest (3) the flange plates of profiled parts 10 and 11 are provided with an attached part (14) facing downwards (see also FIG. 2), which contains a bore (15). The bores (15) accommodate pins (16), in a manner allowing rotation, which pins (16) are provided on either side of legs 17 and 18, which legs (17 and 18) have such dimensions that the legs (17 and 18) can be rotated inside the opening in profiled parts 10 and 11 via the pins (16) and bores (15). The legs (17 and 18) are connected to one another by means of a bar (20), which makes the whole more sturdy and enables the legs (17 and 18) to move kinematically as a whole.

Profiled parts 10 and 11 have flange plates which from the end facing the footrest (3) gradually increase in height in the direction of the end facing the back part (2).

As shown in FIGS. 2 and 3, plate parts (21) are hence formed that have a substantial height compared with the rest of the flange plates of profiled parts 10 and 11. Bores (22) are moulded in these plate parts (21). A shaft pin (23), which bears a wheel (24), in a manner allowing rotation, is inserted into each pair of openings (22) belonging to the same profiled part (10 or 11). This makes it possible to transport the chair as a wheelbarrow.

The footrest (3) is also composed of two longitudinal profiled parts (30 and 31) having a substantially U-shaped cross section, which are connected to one another by a number of transverse connections consisting alternately of narrow profiled parts (32) with U-shaped cross sections and wide profiled parts (33) with U-shaped cross sections. The openings of profiled parts 30, 31, 32 and 33 also face downwards, the web plates substantially lying in one plane and hence constituting the supporting surface of the footrest (3). To increase the sturdiness of the footrest (3) a longitudinal connection (34) is provided halfway between profiled parts 30 and 31, which connects profiled parts 32 and 33 to one another. A U-shaped profiled part (35 and 36) is provided against each of the outer flange plates of profiled parts 30 and 31, respectively, which profiled parts (35 and 36) extend partly along profiled parts 30 and 31 and curve downwards towards the foot end to thus constitute two legs to support the footrest (3).

Each of the ends of profiled parts 30 and 31 facing the seat part is provided with an extension, 37 and 38, respectively, shaped as a profiled part with a U-shaped cross section, whose dimensions are chosen such that it fits into profiled parts 10 and 11. The flange plates of the extensions are extended downwards near their free ends and are provided with bores (39), whose diameters correspond to the diameters of bores 15. The dimensions of the design are such that bores 39 can be placed opposite bores 15 and the pins (16) of the legs (17 and 18) can be inserted into them. In this manner the footrest (3) can be hinged relative to the seat part (1) so that the bottom side of the footrest (3) comes to lie against the bottom side of the seat part (1).

By providing a buffer plate (not shown) between each pair of flange plates of the extensions (37 and 38) at the correct distance from the bore (39) it can be ensured that, when the footrest (3) is turned from the position parallel to the seat part to the position in line with the seat part, the legs (17 and 18) are automatically taken along from a position parallel to the seat part to a position virtually perpendicular to the seat part, in which the latter is supported.

In the vicinity of the plate parts (21) of profiled parts 10 and 11 the latter's flange plates are extended in upward direction with attachments 40, 41, 42 and 43, in which bores (44, 45, 46 and 47) are provided. The web plates of profiled parts 10 and 11 end at the level of these attachments. A little further towards the top end or the back part (2) the web plate is present again, but at a lower level, as illustrated in FIGS. 2 and 3. Bores 44–47 constitute the bearing points of the back part (2), as described below.

The back part (2) consists of a U-shaped curved profiled part (50), which profiled part has a U-shaped cross section, the parallel parts of the profiled part (50) being connected by a number of transverse connections consisting of profiled parts (51) with U-shaped cross sections. The openings of the profiled parts (50 and 51) face the same side and the web plates of the profiled parts hence constitute a supporting surface that can serve as a back part or as a headrest.

To increase the sturdiness of the back part a longitudinal connection (52) is provided halfway between the parallel parts of profiled part 50, which connects profiled parts 51 to one another.

The width of the free ends of profiled part 50 is chosen so that those ends fit into the openings (48 and 49) formed in the web plates of profiled parts 10 and 11. In addition, bores (53 and 54) are provided in the free ends of profiled part 50, which, when the free ends of profiled part 50 are placed in the openings (48 and 49), can be positioned in line with bores 44, 45, 46 and 47. By providing shaft pins (55) through openings 44, 45 and 53 and 46, 47 and 54, respectively, a hinged connection is realised between the seat part (1) and the back part (2). Because the web plate of profiled parts 10 and 11 becomes lower towards the back part it is possible to position the back part in line with the seat part. On the other hand, because the axis of bores 44, 45, 46 and 47 virtually coincides with the plane of the seat part and the axis of bores 53 and 54 virtually coincides with the supporting surface of the back part (2), it is possible to turn the back part completely against the seat part, so that they are virtually parallel to one another.

As clearly illustrated in FIGS. 2 and 3, each free end of profiled part 50 is provided with toothed wheel segments (60, 61) shaped like a ratchet wheel, having teeth, one flank of which runs substantially in a radial direction while the other flank is at a sharp angle relative to the radial direction. The axis of the toothed wheel segments (60, 61) coincides with the axis of rotation between the seat part (1) and the back part (2).

The toothed wheel segments (60 and 61) do not extend across the full width of profiled part 50 at the latter's free ends. A cam (62) is moulded against the sides of those ends facing one another, next to the toothed wheel segments (60 and 61), which cam has a larger outer radius than the teeth of the toothed wheel segments. Inside each profiled part (10 and 11) of the seat part (1) is a lever (65, 66). The lever (65, 66) consists of a profiled part with a U-shaped cross section having dimensions that fit inside profiled parts 10 and 11, respectively.

A shaft end (67) is moulded against the outside of the outer flange plate, which shaft end mates with a bore (68) in the outer flange plate of profiled parts 10 and 11. The inside flange plates of profiled parts 65 and 66 are connected to one another via a bar (63). The outer flange plates of profiled parts 65 and 66 at the end facing the footrest (3) bear profiled parts, 69 and 70, respectively, which project beyond the outer flange plates of profiled parts 10 and 11. Optionally, an additional handle is moulded on profiled parts 69 and 70. A groove (72) is moulded in the top surface of profiled parts 69 and 70, which groove can mate with a lip (71) provided with a barb, which lip projects downwards from the web plate of profiled parts 10 and 11, respectively. The relative dimensions of the lever (65 and 66, respectively) are such that in the normal position the end facing the footrest is pressed downwards by the force of gravity. This can be realised either by choosing an appropriate point of rotation (67, 68) or through distribution of weight. When the lever (65, 66) is moved in the other direction by some force then the groove (72) presses itself over the barb of the lip (71) and the lever remains in this position until it is released from it by some other external force.

Viewed in the transverse direction, i.e. in the direction perpendicular to the flange plates, the other end of the lever (65, 66) consists of two parts. Two teeth (75, 76) shaped like barbs are moulded in the outer part, which teeth engage with the toothed wheel segments (60 and 61) so that the back part (2) can be fixed in a number of separate positions. The inner part is shaped as a cam follower track (77) which engages with the cam (62). The cam (62) then describes the circular orbit A, indicated in FIGS. 2 and 3. A cam (78, 79) is provided on top of the web plate of the profiled part constituting the lever (65 and 66, respectively), which cam, as indicated in FIGS. 2 and 3, projects partly into the orbit of cam 62.

The mechanism operates with the aid of the lever (65, 66) as follows.

When the back part in FIG. 2 or 3 is turned to the left so that the back part (2) is in line with the seat part (1) then the engaging of cams 62 and 78 ensures that the groove (72) is pressed away from the barb on the lip (71). The lip (71) has some elasticity to that end. The back part then rests on the web plate of profiled parts 10 and 11 at the level of plate parts 21. The teeth of toothed wheel segments 60 and 61 are in mesh with teeth 75 and 76, respectively.

As a result of the angle of inclination of the flanks of teeth 60, 61, 75 and 76 the back part (2) in FIGS. 2 or 3 can be turned to the right (clockwise), the lever on the left being pressed downwards, until the tops of the teeth have passed one another, after which, due to the force of gravity, the lever automatically returns to the position illustrated in FIG. 2, in which the teeth of 60, 61, 75 and 76 engage again. In this manner the back part can be fixed in a number of separate positions relative to the seat part, enabling completely free movement to a more upright position.

If it is desired to return the back part to a lower position this can be done in two ways.

In the first way the back part (2) in FIG. 2 is turned to the right (clockwise), right up to the seat part (1). Via the cam follower track (77) the cam (62) then presses the lever (65, 66) so far down on that side that at the other end of the lever the groove (72) slides over the barb on the lip (71) and the lever is fixed in this position. In this position the teeth of the toothed wheel segments (60 and 61) are completely free from teeth 75 and 76, which means that the back part (2) can now be turned completely to the left (anticlockwise) until the back part (2) comes to lie in line with the seat part (1). In the last phase of this movement cam 62 presses against cam 78, which causes the lever (65, 66) to be released again. The back part can now once again be moved freely to the right until the desired position is reached.

In the second way the user of the chair can operate the lever (65, 66) by pressing the end of profiled part 69 and/or 70 upwards, which causes the teeth of the toothed wheel segments (60 and 61) to be released from teeth 75 and 76. The back part (2) can now be moved freely. As soon as the user stops pulling the ends of profiled parts 69 and/or 70 upwards, the back part (2) is fixed again.

I claim:

1. Chair comprising:

a seat part, a back part hinged to the seat part, the back part being rotatable relative to the seat part between a first extreme position in which the back part rests on the seat part and a second extreme position in which the back part lies in line and level with the seat part, one of the parts being provided with a toothed segment having teeth of sawtooth shape, the other part being provided with a catch at a first end of a lever arm which engages with the toothed segment to fix said other part in various positions at least against a movement in one direction, and means, acting on the lever arm, for pressing the catch against the toothed segment, said toothed segment including a first cam which projects further than said tooth segment relative to a point of rotation of said back part, said first cam engaging with a cam follower track formed at said first end of the lever arm and adjacent to the catch, the first cam pressing the catch away from the toothed segment in the first extreme position of the back part, wherein one end of the lever arm includes a member having a sawtooth-shaped end, said member being pressed behind an elastically deformable rim so as to retain the catch in the first extreme position of the back part, and release devices constructed and arranged to release the catch from its retained position in the second extreme position of the back part.

2. Chair according to claim 1, wherein the one end of the lever arm which bears said member defines a second end of the lever arm which is opposite said first end thereof.

3. Chair according to claim 2, wherein a handle is moulded near said second end of the lever arm, with which handle the lever arm can be moved.

4. Chair according to claim 1 wherein the lever arm is constructed and arranged such that as a result of the force of gravity, the lever arm is pressed into a position in which the catch engages the toothed segment.

5. Chair according to claim 1, wherein the lever arm contains a second cam against which, in the second extreme position of the back part, the first cam is pressed so that the lever arm is pressed in a direction opposite to a direction of movement generated when the cam actuates the cam follower.

6. Chair according to claim 1, further comprising an actuator which can be actuated by hand to release the catch from the toothed segment in any desired position of the back part.

* * * * *